US006334294B1

(12) United States Patent
Belsom et al.

(10) Patent No.: US 6,334,294 B1
(45) Date of Patent: Jan. 1, 2002

(54) COMBUSTION CROSSFIRE TUBE WITH INTEGRAL SOFT CHAMBER

(75) Inventors: Keith Cletus Belsom, Laurens; Marshalla Michelle Wright, Simpsonville, both of SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/571,834

(22) Filed: May 16, 2000

(51) Int. Cl.[7] ..... F02C 13/10; F02G 3/00
(52) U.S. Cl. ..... 60/39.02; 60/39.37
(58) Field of Search ..... 60/39.06, 39.32, 60/39.37, 39.821, 39.02

(56) References Cited

U.S. PATENT DOCUMENTS 3,001,366 A * 9/1961 Shutts ..... 60/39.82
4,249,372 A * 2/1981 White ..... 60/39.32
5,265,413 A * 11/1993 Cannon et al. ..... 60/39.32
5,896,742 A * 4/1999 Black et al. ..... 60/39.37

* cited by examiner

*Primary Examiner*—Charles G. Freay
*Assistant Examiner*—William H Rodriguez
(74) *Attorney, Agent, or Firm*—Nixon & Vanderhye P.C.

(57) ABSTRACT

A crossfire tube for connecting adjacent combustors in a gas turbine, the crossfire tube includes a hollow tubular body having opposite end portions adapted to be secured to the adjacent combustors; an annular chamber surrounding a mid-section of the hollow tubular member; a first plurality of purge air feed holes in an outer wall of the chamber, and a second plurality of purge air feed holes in an inner wall of the chamber opening into the crossfire tube. A method of supplying purge air to a crossfire tube located between a pair of adjacent combustors in a gas turbine, where the crossfire tube includes a hollow tubular body adapted for connection between the adjacent combustors, includes the steps of establishing a chamber about the tubular body; utilizing compressor discharge air as crossfire tube purge air; feeding the purge air at a first pressure approximately equal to the compressor discharge air pressure into the chamber to thereby reduce the pressure to a second, lower pressure; and subsequently feeding the purge air from the chamber into the tubular body of the crossfire tube at the lower pressure.

10 Claims, 2 Drawing Sheets

COMBUSTION CROSSFIRE TUBE WITH INTEGRAL SOFT CHAMBER

BACKGROUND OF THE INVENTION

This invention relates to crossfire tubes extending between adjacent combustors in a land-based gas turbine.

The annular arrangement of combustors in a stationary, or land-based gas turbine with interconnecting crossfire tubes is generally well known as disclosed in, for example, commonly owned U.S. Pat. No. 4,249,372. As disclosed in the '372 patent, a typical cross ignition assembly comprises tubular members extending between aligned openings in adjacent combustors that are held in place by means that position the opposite ends of the tubular members or crossfire tubes in fluid communication with the adjacent combustion chambers. The purpose of the crossfire tubes is to provide for the ignition of fuel in one combustion chamber from ignited fuel in an adjacent combustion chamber, thereby eliminating the need for a separate igniter in each combustor. Specifically, when chamber to chamber crossfire is desired, it is accomplished by a pressure pulse of hot gases transferring from a firing chamber to an unfired chamber through the crossfire tube. The crossfire tubes also serve the purpose of equalizing to some extent the pressures between combustion chambers.

Current crossfire tube design includes a plurality of purge air holes (usually six) arranged about the circumference of the crossfire tube, approximately midway along its axial length. An arrangement of this type is disclosed in commonly owned U.S. Pat. No. 5,896,742. Purge air is fed to the crossfire tube purge air holes at approximately the compressor discharge pressure so as to prevent unwanted migration of oil (unburned fuel) between adjacent combustors. This purge air, however, opposes the cross-firing pressure pulse, and can actually prevent firing of the adjacent combustor. Specifically, the purge air feed pressure and flow rate both inherently resist the crossfire pressure pulse. Inhibiting oil intrusion, however, is controlled by the purge air flow rate combined with the convergence of the tube shape. Thus, a minimum discharge flow rate out of the crossfire tubes is necessary to inhibit oil intrusion into the crossfire tube. Oil intrusion is a source of auto ignition, which, in turn, is a cause of failure of the gas turbine to correctly operate. Accordingly, the purge air flow rate must be sufficient to inhibit oil intrusion, but the combined pressure and flow rate must not be too great to keep a pressure pulse of hot gases from transferring from one combustion chamber to the other through the crossfire tube. Compressor discharge pressure and the crossfire tube purge air hole size set the flow rate inside the crossfire tubes. Attempts to balance the crossfire performance and resistance to oil intrusion by varying the hole size, however, have not been successful. It has been found that the feed pressure and flow rate are either too high to consistently achieve good crossfire or are too low to inhibit oil intrusion.

Thus, the problem to be solved is that the flow rate cannot be decreased to improve crossfire performance without risking an increase of oil intrusion, and possibly other harmful effects elsewhere in the combustion turbine.

Some model gas turbines have reduced the purge air feed pressure to the crossfire tubes by mechanical blockage for reasons divorced from crossfire tube performance. These gas turbines have good crossfire performance but, since they do not operate on oil, they do not have the same design constraints with respect to oil intrusion into the crossfire tubes.

BRIEF SUMMARY OF THE INVENTION

In accordance with this invention, both purge air feed pressure to the crossfire tube and the purge air flow rate within the crossfire tube are separately affected by creating a pressure drop mechanism upstream of the purge air feed holes into the crossfire tube. This is accomplished by creating an integral chamber as part of the crossfire tube assembly that will operate such that during crossfire, the purge air is temporarily "stalled" in the integral chamber. This is made possible by reducing the purge feed pressure such that the re-light pulse from the firing chamber to the unfired chamber can overcome the pressure drop across the purge feed holes.

Thus, in accordance with the broader aspects of the invention, there is provided a crossfire tube for connecting adjacent combustors in a gas turbine, the crossfire tube comprising a hollow tubular body having opposite end portions adapted to be secured to the adjacent combustors; an annular chamber surrounding a mid-section of the hollow tubular member; a first plurality of purge air holes in an outer wall of the chamber, and a second plurality of purge air holes in an inner wall of the chamber opening into the crossfire tube.

In another aspect, the invention provides a crossfire tube assembly for connecting adjacent combustors in a gas turbine, the crossfire tube assembly comprising a hollow tubular body having opposite end portions and a plurality of purge air feed holes arranged in a circumferential array about a mid-section of the hollow tubular body and adapted to feed purge air into the hollow tubular body; the hollow tubular body having means for reducing compressor discharge air pressure prior to entry into the hollow tubular body.

In still another aspect, the invention relates to a method of supplying purge air to a crossfire tube located between a pair of adjacent combustors in a gas turbine, the crossfire tube including a hollow tubular body adapted for connection between the adjacent combustors, the method comprising establishing a chamber about the tubular body; utilizing compressor discharge air as crossfire tube purge air; feeding the purge air at a first pressure approximately equal to the compressor discharge air pressure into the chamber to thereby reduce the pressure to a second, lower pressure; and subsequently feeding the purge air from the chamber into the tubular body of the crossfire tube at the lower pressure.

DETAILED DESCRIPTION OF THE INVENTION

Figure 1:
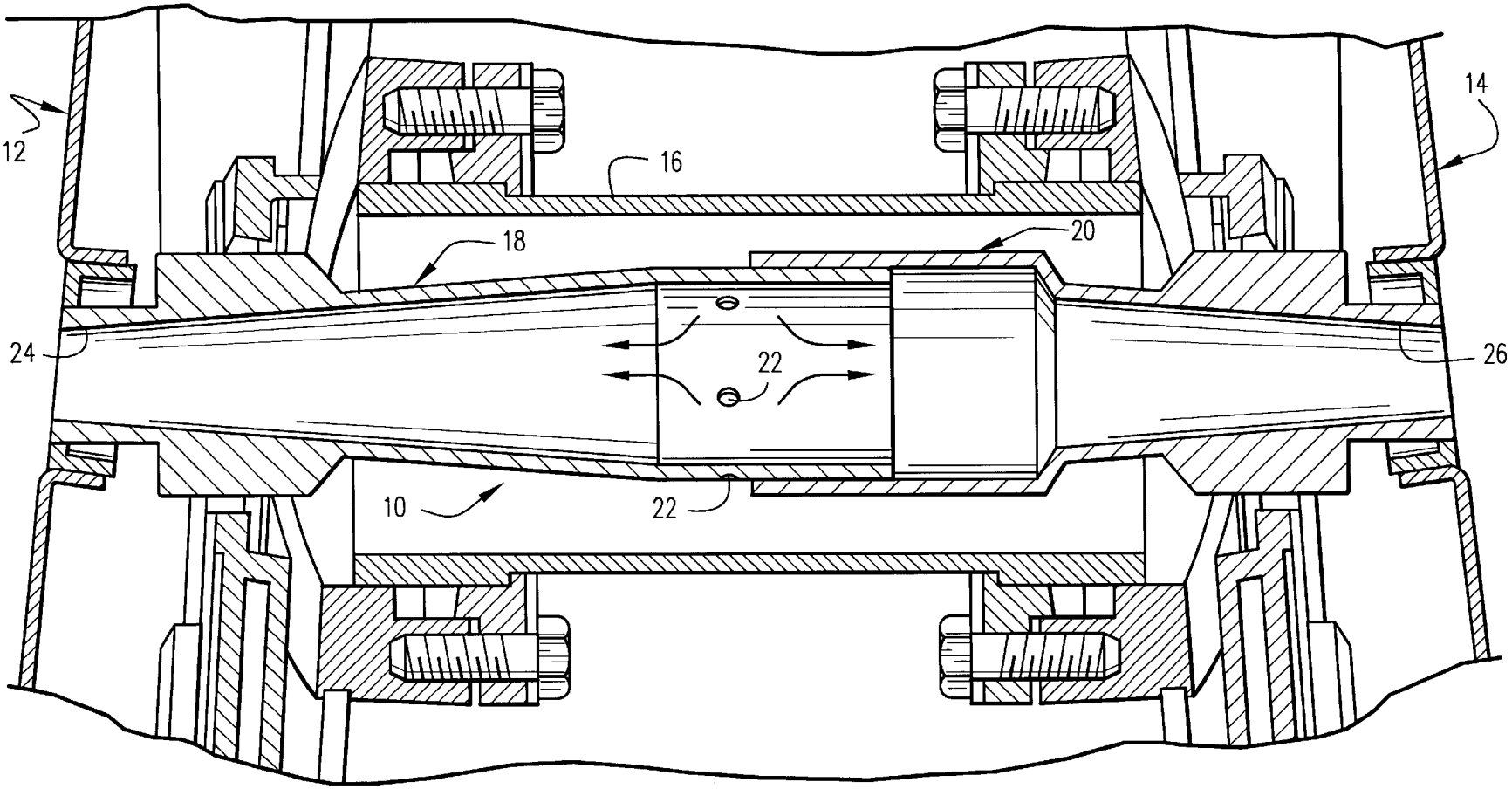
Fig.1 (PRIOR ART)
FIG. 1 is a cross section of a prior art crossfire tube construction.

A known crossfire tube configuration is shown in FIG. 1. The crossfire tube 10 extends between a first combustor 12 and a second combustor 14, and is surrounded by a vessel 16 that is open to the flow of compressor discharge air. The crossfire tube itself comprises a pair of tubular sections joined in a telescoping relationship. Specifically, the crossfire tube includes a first section 18 that is slidably received within a second section 20, and secured therein mechanically and/or by any other suitable means. A plurality of purge air feed holes 22 are drilled in the section 18 adjacent the telescoping joint with section 20. The tubular sections 18 and 20 each taper from a larger diameter in the mid-section of the crossfire tube, to smaller diameters at the ends 24, 26, respectively, where the ends are joined to the combustors 12 and 14. The taper at the ends of the crossfire tube causes the purge air flow to accelerate and be forced against the tube walls so that the purge air fills the entire cross section of the opposite ends of the tube. This arrangement, however, has not been completely successful in inhibiting oil intrusion into the crossfire tube at some flow conditions, and may also inhibit good crossfire at other pressure and flow conditions, due to the acceleration of purge air in a direction opposite the crossfire pressure pulse.

Figure 2:
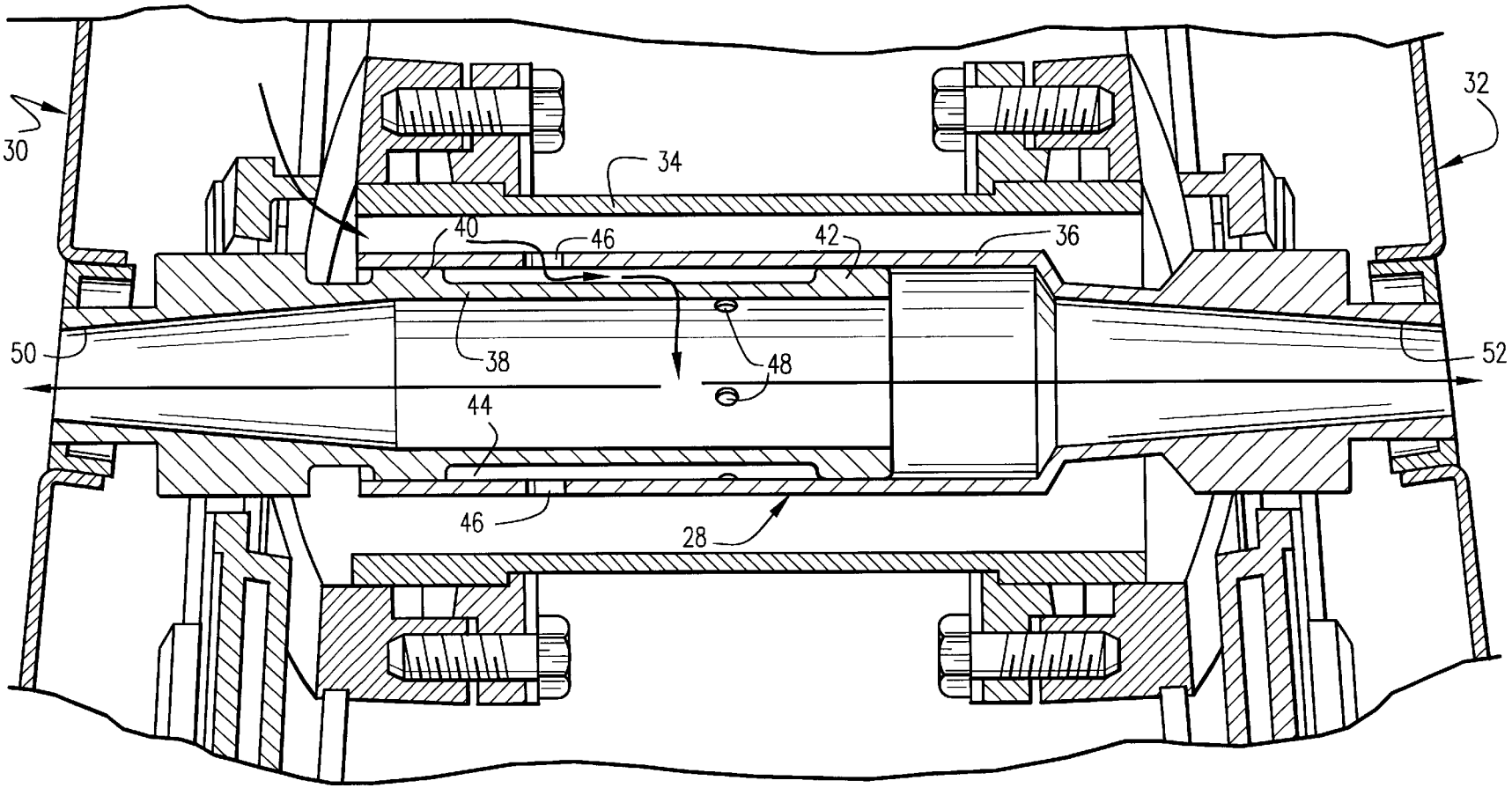
FIG. 2 is a cross section of a crossfire tube in accordance with this invention.

Turning to FIG. 2, a crossfire tube in accordance with an exemplary embodiment of the invention is arranged between adjacent combustors 30 and 32, and surrounded by pressure vessel 34 similar to vessel 16. The crossfire tube is essentially a hollow, tubular body 28 made up of two mating tubular sections 36 and 38. The smaller diameter or inner section 38 is adapted to slide into a larger diameter portion of an outer section 36 in telescoping relationship. The inner section 38 is configured, however, to include axially spaced, raised annular lands 40, 42 that engage and support the interior surface of the outer section 36. This arrangement also creates an annular chamber 44 radially between the inner and outer sections 38, 36, extending axially between the lands 40, 42 generally in the central area of the crossfire tube. A first plurality of purge air feed holes 46 (also referred to as "sleeve holes" to facilitate differentiation vis-a-vis the purge air feed holes 48) are formed in the outer section 36. A second plurality of purge air feed holes 48 are formed in the inner section 38, axially between the lands 40, 42 and opening into the crossfire tube. Note that outer section 36 also forms an "outer wall" of the chamber 44 while inner section 38 also forms an "inner wall" of the chamber. The purge air feed holes 48 are also axially spaced from the sleeve holes 46. The end portions 50, 52 of the crossfire tube may taper to approximately equal smaller diameters where the end portions are secured to the adjacent combustors 30, 32 in otherwise conventional fashion.

With this arrangement, compressor discharge air will flow into the vessel 34 (as indicated by the flow arrows), through the sleeve holes 46 in the outer section 36 and into the chamber 44. The purge air then flows through purge air feed holes 48 into the crossfire tube 28, flowing in opposite directions towards combustors 30, 32. By flowing through holes 46, a pressure drop is created such that a lower pressure exits in chamber 44 so that the purge air entering the air feed holes 48 is at a pressure less than the compressor discharge air pressure. In other words, the pressure pulse necessary to establish good crossfire performance is not resisted by the full compressor discharge pressure. The purge air pressure within chamber 44 and the purge air flow rate into the crossfire tube can be independently varied by selecting the appropriate sizes for holes 46 and 48, as well as the number of such holes about the inner and outer sections 38, 36.

The volume of the chamber 44 must be adequate to accumulate suspended purge air flow for a short period without raising the pressure in the chamber significantly, or else the flow into the crossfire tube during crossfire will increase and the temperature of the crossfire relight pulse will be diluted.

In one specific example, successful results were achieved using six sleeve holes 46 and six purge air feed holes 48. The sleeve hole diameter was 0.297 inch while the purge air feed hole diameter was 0.344 inch. With a purge air mass flow rate of 0.192 pps, the pressure upstream of the sleeve holes 46 was 121 psi and the reduced pressure in the chamber 44 upstream of the purge air feed holes 48 was 118.9 psi.

The success of the above design is predicated on two separate factors: (1) an ability to closely control the purge air pressure and flow rate via the unique mechanical arrangement; and (2) the ignition pressure pulses' response to a reduction in purge air pressure and change in purge air flow rate. These functions are addressed in connection with specific application of the invention to different model turbines to determine the size and number of holes 46 and 48 in sections 36 and 38 of the crossfire tube. The success is also dependent on flow rates that are sufficient to inhibit oil intrusion.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A crossfire tube for connecting adjacent combustors in a gas turbine, the crossfire tube comprising a hollow tubular body having opposite end portions adapted to be secured to the adjacent combustors; an annular chamber surrounding a mid-section of said hollow tubular member; a first plurality of purge air holes in an outer wall of said chamber, and a second plurality of purge air holes in an inner wall of said chamber opening into said crossfire tube.

2. The crossfire tube of claim 1 wherein said first plurality of purge air feed holes are axially offset from said second plurality of purge air feed holes.

3. The crossfire tube of claim 1 wherein said hollow tubular body is formed in two sections joined in telescoping relationship.

4. The crossfire tube of claim 3 wherein an inner one of said two sections is formed with a pair of axially spaced, raised annular lands, and wherein an outer one of said two sections is seated on said raised annular lands, thereby creating said annular chamber.

5. The crossfire tube of claim 4 wherein said first plurality of purge air feed holes is arranged in a circumferential array about said outer one of said two sections, between said pair of raised annular lands.

6. The crossfire tube of claim 5 wherein said second plurality of purge air feed holes is arranged in a circumferential array about said inner one of said two sections, between said pair of raised annular lands, but axially offset from said first plurality of purge air feed holes.

7. A crossfire tube assembly for connecting adjacent combustors in a gas turbine, the crossfire tube assembly comprising a hollow tubular body having opposite end portions and a plurality of purge air feed holes arranged in a circumferential array about a mid-section of said hollow tubular body and adapted to feed purge air into said hollow tubular body; said hollow tubular body having means for reducing compressor discharge air pressure prior to entry into said hollow tubular body.

8. A method of supplying purge air to a crossfire tube located between a pair of adjacent combustors in a gas turbine, the crossfire tube including a hollow tubular body adapted for connection between the adjacent combustors, the method comprising:

establishing a chamber about said tubular body; utilizing compressor discharge air as crossfire tube purge air; feeding the purge air at a first pressure approximately equal to the compressor discharge air pressure into said chamber to thereby reduce said pressure to a second, lower pressure; and subsequently feeding the purge air from said chamber into said tubular body of said crossfire tube at said lower pressure.

9. The method of claim 8 including providing a first plurality of purge air feed holes for feeding the purge air into said chamber and a second plurality of purge air feed holes for feeding said purge air from said chamber into said hollow tubular body.

10. The method of claim 9 wherein said first plurality of purge air feed holes and said second plurality of purge air feed holes are axially offset.

* * * * *